US007547243B2

(12) United States Patent
Wiswesser et al.

(10) Patent No.: US 7,547,243 B2
(45) Date of Patent: Jun. 16, 2009

(54) METHOD OF MAKING AND APPARATUS HAVING POLISHING PAD WITH WINDOW

(75) Inventors: Andreas Norbert Wiswesser, Freiberg (DE); Ramiel Oshana, San Jose, CA (US); Kerry F. Hughes, San Francisco, CA (US); Jay Rohde, San Jose, CA (US); David Datong Huo, Campbell, CA (US); Dominic J. Benvegnu, La Honda, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/840,499

(22) Filed: Aug. 17, 2007

(65) Prior Publication Data

US 2007/0281587 A1 Dec. 6, 2007

Related U.S. Application Data

(62) Division of application No. 10/669,544, filed on Sep. 23, 2003, now Pat. No. 7,264,536.

(51) Int. Cl.
*B24B 49/12* (2006.01)

(52) U.S. Cl. ..... 451/6; 451/533; 51/297

(58) Field of Classification Search ..... 451/6, 451/5, 533, 534; 51/293, 297, 298
See application file for complete search history.

(56) References Cited

U.S. PATENT DOCUMENTS

| | | | |
|---|---|---|---|
| 4,927,485 | A | 5/1990 | Cheng et al. |
| 5,020,283 | A | 6/1991 | Tuttle |
| 5,081,796 | A | 1/1992 | Schultz |
| 5,177,908 | A | 1/1993 | Tuttle |
| 5,196,353 | A | 3/1993 | Sandhu et al. |
| 5,257,478 | A | 11/1993 | Hyde |
| 5,297,364 | A | 3/1994 | Tuttle |
| 5,329,734 | A | 7/1994 | Yu |
| 5,394,655 | A | 3/1995 | Allen et al. |
| 5,413,941 | A | 5/1995 | Koos et al. |
| 5,433,651 | A | 7/1995 | Lustig et al. |
| 5,486,129 | A | 1/1996 | Sandhu et al. |
| 5,489,233 | A | 2/1996 | Cook et al. |
| 5,605,760 | A | 2/1997 | Roberts |

(Continued)

FOREIGN PATENT DOCUMENTS

| | | | |
|---|---|---|---|
| EP | 0 663 265 | A1 | 7/1995 |

(Continued)

OTHER PUBLICATIONS

Anonymous, Endpoint Detection of Oxide Polishing and Planarization of Semiconductor Devices, Research Disclosure No. 340, Kenneth Mason Publication, Ltd., Aug. 1992.

(Continued)

*Primary Examiner*—Robert Rose
(74) *Attorney, Agent, or Firm*—Fish & Richardson

(57) ABSTRACT

A polishing layer of a polishing has a window member with a top surface positioned a predetermined distance below the polishing surface. A transparent layer can be positioned below the polishing layer and supporting the window member.

12 Claims, 4 Drawing Sheets

U.S. PATENT DOCUMENTS

| | | | | |
|---|---|---|---|---|
| 5,609,511 | A | 3/1997 | Moriyama et al. | |
| 5,663,797 | A | 9/1997 | Sandhu | |
| 5,672,091 | A | 9/1997 | Takahashi et al. | |
| 5,838,447 | A | 11/1998 | Hiyama et al. | |
| 5,893,796 | A | 4/1999 | Birang et al. | |
| 5,910,043 | A | 6/1999 | Manzonie et al. | |
| 5,949,927 | A | 9/1999 | Tang | |
| 5,964,643 | A | 10/1999 | Birang et al. | |
| 6,045,439 | A | 4/2000 | Birang et al. | |
| 6,280,290 | B1 | 8/2001 | Birang et al. | |
| 6,358,130 | B1 * | 3/2002 | Freeman et al. | 451/285 |
| 6,458,014 | B1 * | 10/2002 | Ihsikawa et al. | 451/6 |
| 6,524,164 | B1 * | 2/2003 | Tolles | 451/6 |
| 6,537,133 | B1 * | 3/2003 | Johansson et al. | |
| 6,832,950 | B2 * | 12/2004 | Wright et al. | 451/490 |

FOREIGN PATENT DOCUMENTS

| | | |
|---|---|---|
| EP | 0 738 561 A1 | 10/1996 |
| EP | 0 846 040 | 2/1997 |
| FR | 1075634 | 10/1954 |
| JP | 58-004353 | 1/1983 |
| JP | 6037076 | 10/1983 |
| JP | 62-211927 | 8/1987 |
| JP | 2-222533 | 9/1987 |
| JP | 05138531 | 9/1990 |
| JP | 3-234467 | 10/1991 |
| JP | 5-309558 | 11/1993 |
| JP | 58178526 | 11/1993 |
| JP | 62-190726 | 2/1994 |
| JP | 7-52032 | 2/1995 |
| JP | 9-036072 | 1/1997 |
| WO | WO93/20976 | 10/1993 |
| WO | WO 94/07110 | 3/1994 |

OTHER PUBLICATIONS

Rodel, "Glass Polishing Pad", Jan. 1993.

* cited by examiner

METHOD OF MAKING AND APPARATUS HAVING POLISHING PAD WITH WINDOW

CROSS-REFERENCE TO RELATED APPLICATIONS

This application is a divisional application of and claims priority to U.S. application Ser. No. 10/669,544, filed on Sep. 23, 2003, the entire disclosure of which is incorporated by reference.

BACKGROUND

The invention generally relates to polishing pads with a window, systems containing such polishing pads, and processes for making and using such polishing pads.

The process of fabricating modern semiconductor integrated circuits (IC) often involves forming various material layers and structures over previously formed layers and structures. However, the underlying features can leave the top surface topography of an in-process substrate highly irregular, with bumps, areas of unequal elevation, troughs, trenches, and/or other surface irregularities. These irregularities can cause problems in the photolithographic process. Consequently, it can be desirable to effect some type of planarization of the substrate.

One method for achieving semiconductor substrate planarization or topography removal is chemical mechanical polishing (CMP). A conventional chemical mechanical polishing (CMP) process involves pressing a substrate against a rotating polishing pad in the presence of a slurry, such as an abrasive slurry.

In general, it is desirable to detect when the desired surface planarity or layer thickness has been reached and/or when an underlying layer has been exposed in order to determine whether to stop polishing. Several techniques have been developed for the in situ detection of endpoints during the CMP process. For example, an optical monitoring system for in situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad. A layer of slurry is typically present between the substrate and an upper surface of the window.

SUMMARY

In general, the invention relates to polishing pads with a window, systems containing such polishing pads, and processes that use such polishing pads.

In one aspect, the invention is directed to a polishing pad with a polishing layer having a polishing surface, a window member in an opening of the polishing layer, and a transparent layer positioned below the polishing layer and supporting the window member. The window member has a top surface positioned at least a predetermined distance below the polishing surface.

Implementations of the invention may include one or more of the following features. The top surface and a bottom surface of the window member may be abraded, The transparent layer may include a fluid impermeable layer and/or an adhesive layer.

In another aspect, the invention is directed to a polishing pad having an upper layer including a polishing surface and an opening, a window member extending through at least part of the opening, a supporting layer disposed below the upper layer, and an adhesive layer disposed below the supporting layer. The window member has a top surface positioned at least a predetermined distance below the polishing surface. At least one of the supporting layer and the adhesive layer spans the opening and supports the window member.

Implementations of the invention may include one or more of the following features.

The adhesive layer may include a transparent adhesive and/or a double-sided adhesive tape. A bonding material may attach the window member to the supporting layer. There may be an adhesive between the upper layer and the supporting layer. The supporting layer may include a transparent incompressible polymer sheet. The window member may include a clear polyurethane. The top surface and a bottom surface of the window member may be abraded. A bonding material may attach the window member to the adhesive layer. The supporting layer may include an aperture and the window member may extend through the aperture in the supporting layer. An opening in the adhesive layer may allow an optical monitoring system to monitor a substrate through the window member. A portion of the adhesive layer below the window member may be transparent and a remainder of the adhesive layer may be opaque.

In another aspect, the invention is directed to a method of constructing a polishing pad having a window. The method includes placing a window member on a window member holding portion of a polishing pad so that the window member extends partially through an opening of a polishing layer having a polishing surface and so that a top surface of the window member is spaced a predetermined distance below the polishing surface.

Implementations of the invention may include one or more of the following features. A continuous bead of adhesive sealant may be placed on one or more of a window member and a window member holding portion of a polishing pad, and the adhesive sealant may be cured. The window member may be pressed against the adhesive sealant with a weight-imparting element until the adhesive sealant is cured. A spacer having a depth of the predetermined distance may be placed between the window member and the weight while the adhesive sealant cures. The spacer may include a polytetra-fluoroethylene ("PTFE") sheet. The adhesive sealant may include a viscous rubber-like glue. The adhesive sealant is placed on the window member holding portion and/or on the window member. The window member holding portion may include a supporting layer of the polishing pad. The supporting layer may be a polyethylene terephthalate ("PET") layer. The window member holding portion may include a pressure sensitive adhesive layer. The top surface and a bottom surface of the window member may be abraded. A portion of the polishing layer may be removed to form the opening in the polishing layer.

In another aspect, the invention is directed to a chemical mechanical polishing apparatus that includes a platen, an optical monitoring system housed in a recess of the platen, and a polishing pad mounted on the platen. The polishing pad includes an upper layer including a polishing surface and an opening, a window member extending through at least part of the opening, a supporting layer adjacent a bottom surface of the upper layer, and an adhesive layer between the supporting layer and the platen. The window member has a top surface positioned at least a predetermined distance below the polishing surface, and the optical monitoring system monitors a polishing operation through the window member of the polishing pad.

Implementations of the invention may include one or more of the following features. The optical monitoring system may includes a light source and a light detector. The optical monitoring system may monitor a polishing operation by detecting change in reflectivity of a substrate being polished using the polishing pad.

The details of one or more implementations of the invention are set forth in the accompanying drawings and the description below. Other features, objects, and advantages of the invention will be apparent from the description and drawings, and from the claims.

DETAILED DESCRIPTION

Figure 1:
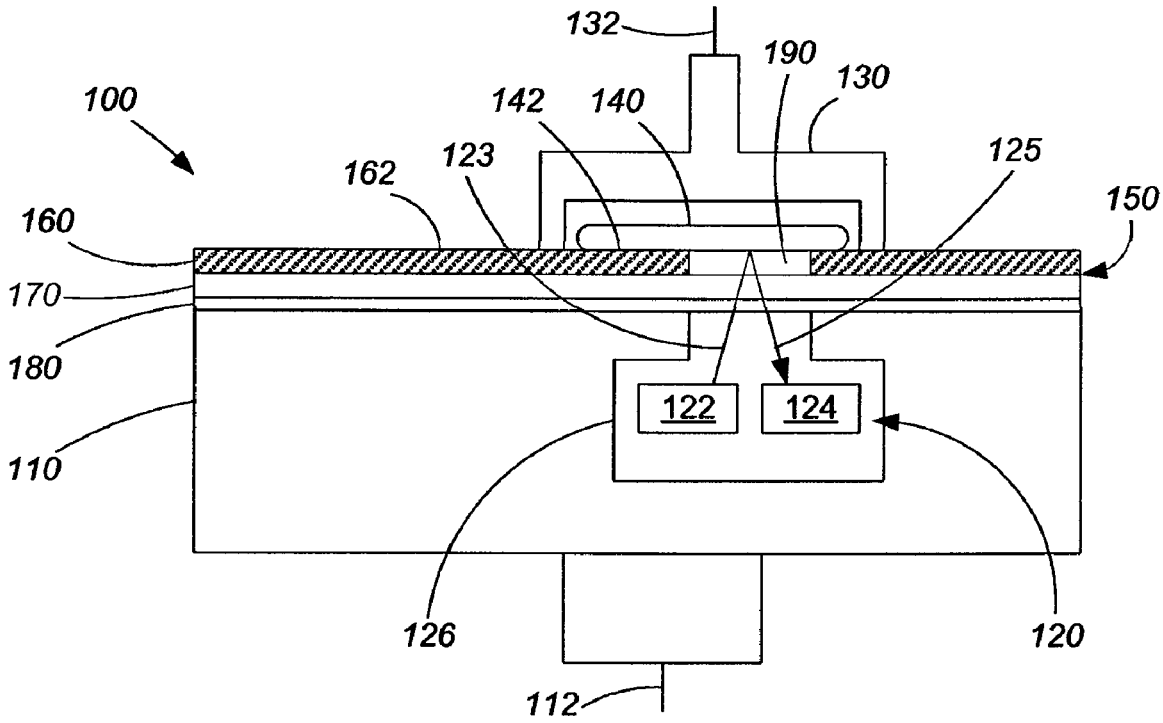
FIG. 1 is a schematic cross-sectional view of a chemical mechanical polishing apparatus containing a polishing pad with a window.

As shown in FIG. 1, a chemical mechanical polishing apparatus 100 includes polishing pad 150 disposed on a platen 110. Platen 110 contains an optical monitoring system 120 including a light source 122 (e.g., a laser, such as a red laser, a blue laser, or an infrared laser, or a light emitting diode, such as a red light emitting diode, a blue light emitting diode, or an infrared light emitting diode) and a light detector 124 (e.g., a photodetector). Optical monitoring system 120 is housed in a recess 126 in platen 110. Apparatus 100 also includes a polishing head 130 for holding a substrate 140 (e.g., a semiconductor wafer, optionally coated with one or more dielectric, conductive or semiconductive layers). Optical monitoring system 120 monitors polishing of substrate 140 through polishing pad window 190, and at least one of a supporting layer 170 and an adhesive layer 180 of polishing pad 150.

In general, during use of apparatus 100 in a CMP process, a chemical polishing solution (e.g., a slurry containing one or more chemical agents and optionally abrasive particles) is applied to polishing surface 162 of covering layer 160 of polishing pad 150. The chemical polishing solution is applied to polishing surface 162 as platen 110, polishing pad 150 and optical monitoring system 120 rotate about an axis 112. Polishing head 130 is lowered so that a surface 142 of substrate 140 comes into contact with slurry/polishing surface 162, and polishing head 130 and substrate 140 are rotated about an axis 132 and translate laterally across the polishing pad. Light source 122 directs light beam 123 at surface 142, and light detector 124 measures the light beam 125 that is reflected from substrate 142 (e.g., from surface 142 and/or the surface of one or more underlying layers in substrate 142).

The wavelength(s) of light in beam 123 and/or 125 can vary depending upon the property being detected. As an example, the wavelength(s) of interest can span the visible spectrum (e.g., from about 400 nm to about 800 nm). As another example, the wavelength(s) of interest can be within a certain portion of the visible spectrum (e.g., from about 400 nm to about 450 nm, from about 650 nm to about 800 nm). As an additional example, the wavelength(s) of interest may be outside the visible portion of the spectrum (e.g., ultraviolet (such as from about 300 nm to about 400 nm), infrared (such as from about 800 nm to about 1550 nm)).

The information collected by detector 124 is processed to determine whether the polishing endpoint has been reached. For example, a computer (not shown) can receive the measured light intensity from detector 124 and use it to determine the polishing endpoint (e.g., by detecting a sudden change in the reflectivity of substrate 142 that indicates the exposure of a new layer, by calculating the thickness removed from the outer layer (such as a transparent oxide layer) of substrate 142 using interferometric principles, and/or by monitoring the signal for predetermined endpoint criteria).

Polishing pad 150 can be suitable for polishing silicon or silicon-on-insulator ("SOI") substrates. Polishing pad 150 can include a compressible or "soft" polishing layer.

Figure 2:
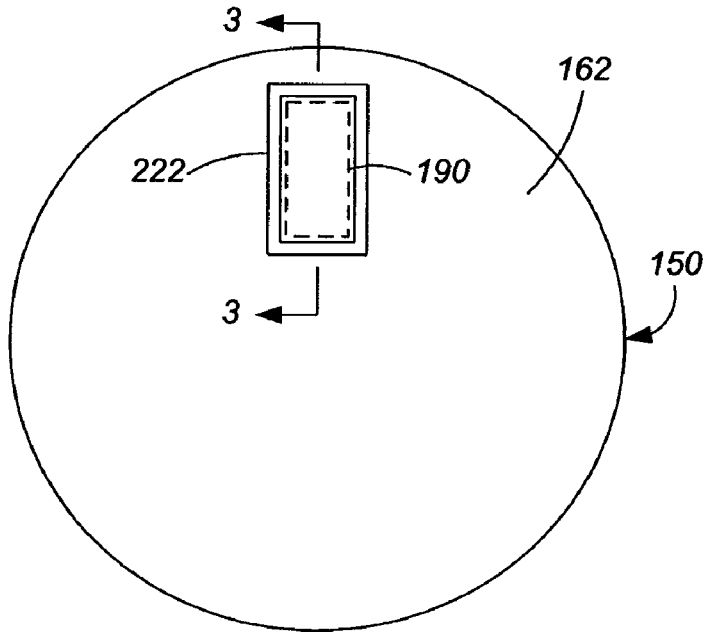
FIG. 2 is a schematic top view of a polishing pad having a window.
Figure 3A:
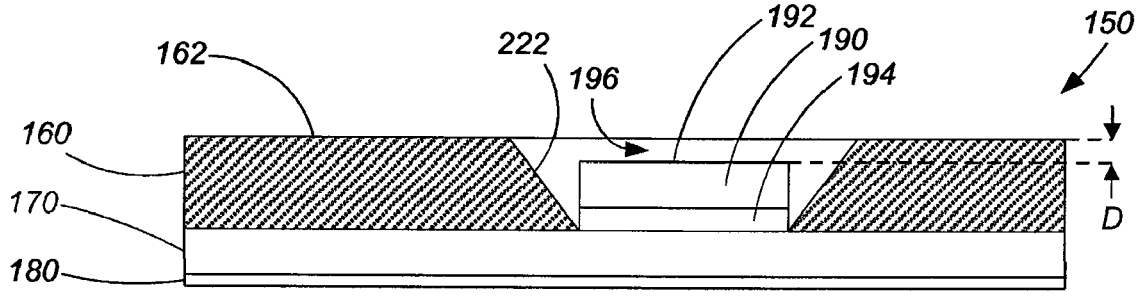
FIG. 3A is a cross-sectional view of the polishing pad of FIG. 2.

As shown in FIGS. 2 and 3A, polishing pad 150 includes a polishing layer 160, a supporting layer 170 and an adhesive layer 180. Polishing layer 160 can include a compressible material, such as a polymeric foam, and has a polishing surface 162. An opening 222 extends through polishing layer 160 so that when the polishing layer is disposed on platen 110, opening 222 overlies recess 126.

The polishing layer 160 can be grown on the supporting layer 170 so that a PSA layer is not needed between the supporting layer 170 and polishing layer 160. For example, a polymer layer can be grown on supporting layer 170 to form the polishing layer 160.

Figure 3B:
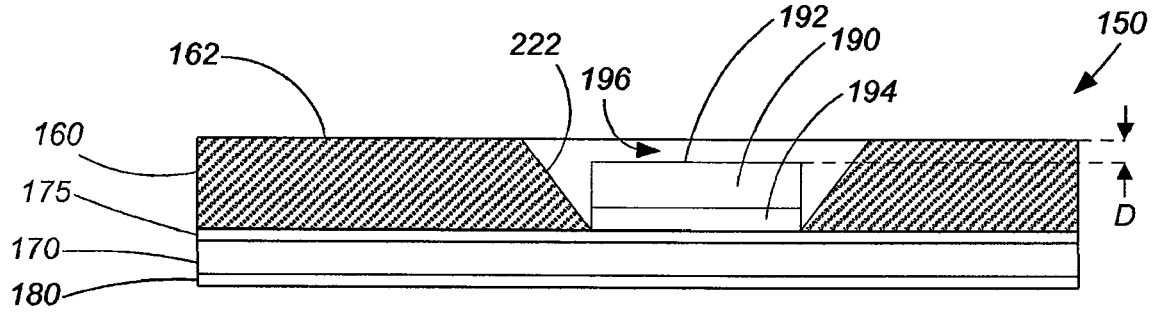
FIG. 3B-3F are cross-sectional views of other implementations of a polishing pad.

Alternatively, as shown in FIG. 3B, the polishing layer 160 can be attached to the supporting layer 170 by an adhesive layer 175, such as a PSA layer.

Referring to either FIG. 3A or 3B, a light-transmissive window member 190 is disposed in opening 222, and extends at least partially through opening 222. Suitable materials for window member 190 are described in "Polishing Pad with Window," U.S. patent application Ser. No. 10/282,730, "Polishing Pad with Transparent Window," U.S. patent application Ser. No. 10/035,391, and "Forming a transparent window in a polishing pad for a chemical mechanical polishing apparatus," U.S. Pat. No. 5,893,796, the entire contents of which are hereby incorporated by reference. For example, window member 190 can be formed of one or more polymeric materials, such as, a polyurethane or a halogenated polymer (e.g., polychlorotrifluoroethylene (PCTFE), perfluoroalkoxy (PFA), fluorinated ethylene propylene (FEP), or polytetrafluoroethylene (PTFE)).

In certain implementations, the material from which window member 190 is made is relatively resistant to the conditions to which it is exposed during the CMP process. The material from which window member 190 is made can be relatively chemically inert to the slurry and substrate material. In addition, the window can be relatively resistant to scratching and/or abrasion caused by the slurry (e.g., containing one or more chemical agents and optionally abrasive particles) the substrate, or the pad conditioner.

In certain implementations, window member 190 can be formed of a material having a Shore D hardness of from about 20-80. If the hardness for the material for window member 190 is not within a desired range, two materials having two different hardness can be combined to provide a material with hardness in the desired range. For example, liquid forms of two materials having two different hardness can be combined in a ratio calculated to achieve the desired hardness, then the combined material can be cured and cut to size to form window member 190.

In some implementations, the material from which window member 190 is made is substantially transparent to energy in the range of wavelength(s) of interest. In certain implementations, at least about 25% (e.g., at least about 35%, at least about 50%, at least about 60%, at least about 70%, at least about 80%, at least about 90%, at least about 95%) of energy at a wavelength of interest that impinges upon window member 190 is transmitted through window member 190.

In certain implementations, the material from which window member 190 is made has a relatively low refractive index. For example, the material from which window member 190 is made can have a refractive index of about 1.48 or less (e.g., about 1.45 or less, about 1.4 or less, about 1.35 or less, about the same as the refractive index of water). Without wishing to be bound by theory, it is believed that using a material having a relatively low refractive index can reduce reflections from the interface at a surface 142 of window member 190 (e.g., an interface of air, water (slurry) and window member 190) and improve transmission of energy having the wavelength(s) of interest, which is believed to improve the signal to noise ratio of the data collected in the CMP process.

In some implementations, window member 190 can be formed of a highly optically isotropic polymer. An isotropic material can help maintain the polarization of the interrogating light beam. For example, the material from which window member 190 is formed can be more isotropic than conventional polyurethanes that are used as window material. A highly optically isotropic polymer can be formed, for example, by molding under low stress conditions.

The material from which window member 190 is formed can be hydrophilic or hydrophobic. A hydrophilic material can help ensure that there is a layer of slurry or water between the substrate and the window. The presence of the layer of slurry or water prevents the creation of an interface which can cause significant signal distortion. Although some polymer materials tend to be hydrophobic, they can be changed from hydrophobic to hydrophilic using surface treatments, such as roughening or etching. However, for certain applications it may be useful for window member 190 to be formed of a relatively hydrophobic window. For example, if a substrate being polished has a hydrophilic layer (SiO2, Si3N4, etc.) on top of hydrophobic layer (Poly Silicon, single crystal Silicon, etc.), then the tendency of the substrate to repel water will increase as the hydrophilic layer is polished away. This transition can be detectable by monitoring the intensity signal from the detector.

In certain implementations, the surface of a material can be modified (e.g., by corona treatment, flame treatment and/or fluorine gas treatment) to increase the surface energy of the material.

A top surface of the window member 190 defines a potential polishing surface 192 of the window member. Both of the polishing surface 192 of the window member 190 and the surface opposite to the polishing surface, i.e., the bottom surface, of the window member 190 can be abraded. The abraded surfaces improve adhesion of the window member 190, and improve interference of light beams in the window member 190 by spreading out the interfering beams.

A window recess 196 is defined between the plane in which polishing surface 162 lies and the plane in which the polishing 192 surface of window member 190 lies. The window recess 196 is designed to be of a predetermined depth D to ensure that when the compressible material forming the polishing layer 160 is compressed, the window member 190 does not extend beyond the polishing layer 160 and scratch the substrate that is being polished. However, the top surface 192 of the window can contact the substrate to provide a polishing surface. The predetermined depth of the window recess 196 is also designed to be small enough so that air bubbles do not form in any chemical polishing solution that leaks between window 190 and substrate 140 during polishing. For example, the window recess 196 can be 3-4 mils deep. Selection of a specific depth to ensure that the window member 190 does not scratch the substrate 140 can take into account on the compressibility of the polishing layer 160 and the load applied to the substrate 140.

In some polishing pads, an opening is formed through the supporting layer to allow an optical monitoring system to monitor the substrate. However, in the pad shown in FIG. 3, supporting material 170 remains without an opening. Supporting material 170 is formed from a transparent material to allow monitoring of polishing progress through the material. The supporting member 170 can be formed of an incompressible and fluid-impermeable polymer. For example, supporting material 170 can be formed of polyethylene terephthalate ("PET") or Mylar®. Thus, chemical polishing solution will not be able to leak through an opening and onto the optical monitoring system 120.

Figure 3C:
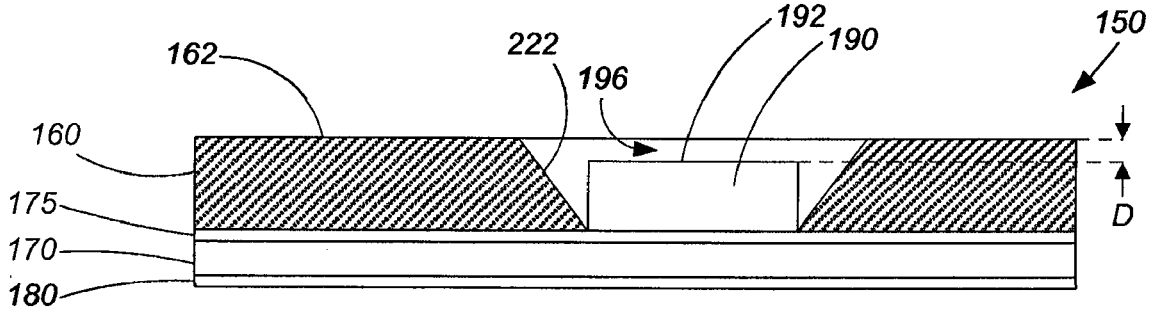
Figure 3D:
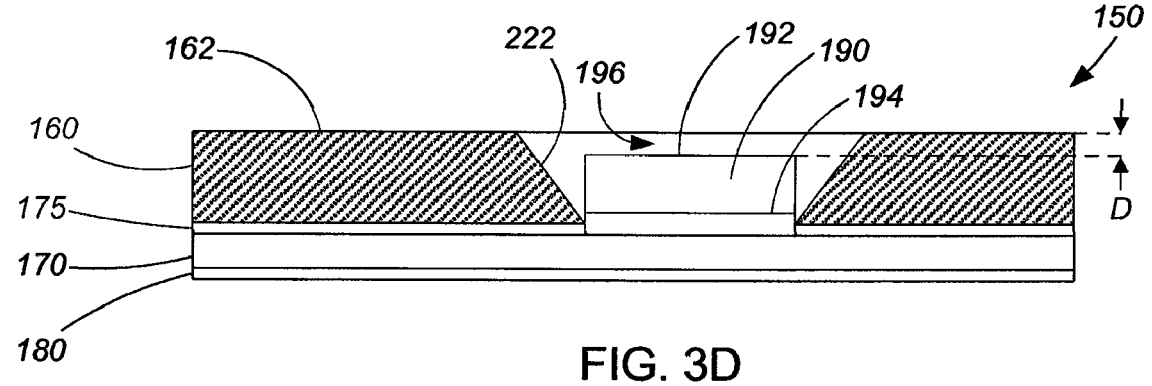

The window member 190 is secured to supporting layer 170 by a window bonding adhesive 194. The window member can be bonded using window bonding adhesive 194 directly to the supporting layer 170 (as shown in FIG. 3A), or to an optional adhesive or PSA layer 175 between supporting layer 170 and polishing layer 160 (as shown in FIG. 3B). As discussed above, the polishing layer 160 can be grown directly on the supporting layer, but alternatively, the adhesive or PSA layer can be used to join polishing layer and the supporting layer. Alternatively, as shown in FIG. 3C, the window member 190 could be adhered directly to the adhesive layer 175 (without the window bonding layer). In addition, as shown in FIG. 3D, an aperture could be formed in the adhesive layer 175, and the window and/or window bonding adhesive could fit into the aperture and secured to the supporting layer 170.

The window bonding adhesive 194 is composed of a material that seals any gap between the window member support layer, such as supporting layer 170 or a PSA layer, and window member 190. The window bonding adhesive also supports the window against shear stress during polishing. Window bonding adhesive 194 can include an adhesive sealant, such as a viscous rubber-like glue. For example, for some PSA layers, window bonding adhesive 194 can include one-part room temperature vulcanizing ("RTV") silicone TSE399™ or TSE397™ distributed by GE Silicones of Waterford, N.Y.

The adhesive layer 180 can be formed from a pressure sensitive adhesive ("PSA"). PSAs used in forming polishing pads can be a material that is not transparent, such as a PSA that is yellow in color. A typical yellow PSA diffuses and absorbs light. For example, for a 670 nm beam, about 10% (f the initial intensity ("$I_0$") may pass through the adhesive layer 180, while for a 405 nm beam, less than 2% of the $I_0$ may pass through the adhesive layer 180. Since the beam 123, 125 from the optical monitoring system needs to pass through the adhesive layer 180 twice, the resulting intensity seen by the detector 124 may be less than 1% $I_0$ for the 670 nm beam and less than 0.04% $I_0$ for the 405 nm beam. Thus, intensity scattered back from the adhesive layer 180 into the detector may be larger than the signal 125 from the substrate.

Figure 3E:
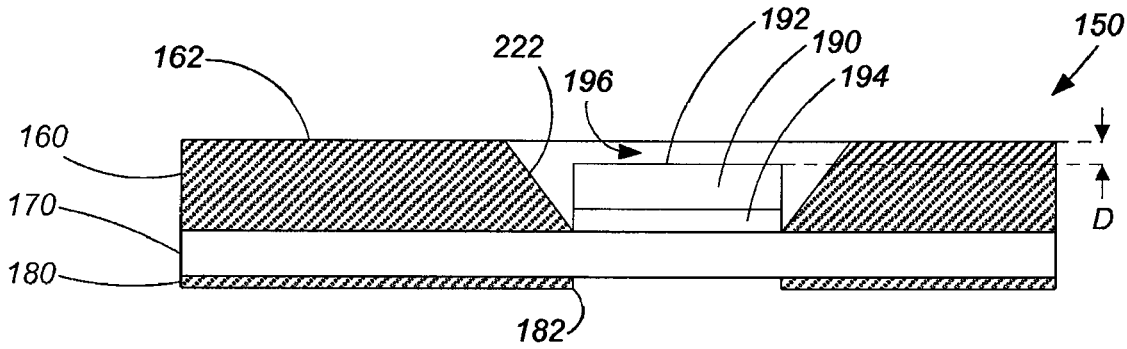

As shown in FIG. 3E, a portion of adhesive layer 180 can be removed for optical monitoring to provide an aperture 182 in order to improve light transmission through the polishing pad. The portion 182 of adhesive layer 180 that is removed can include the portion of adhesive layer 180 underneath at least part of the window member 190 and overlying an opening into recess 126. Removal of the adhesive layer 180 will increase the signal 125 from the substrate by 20 to 40 times, depending on wavelength.

Figure 3F:
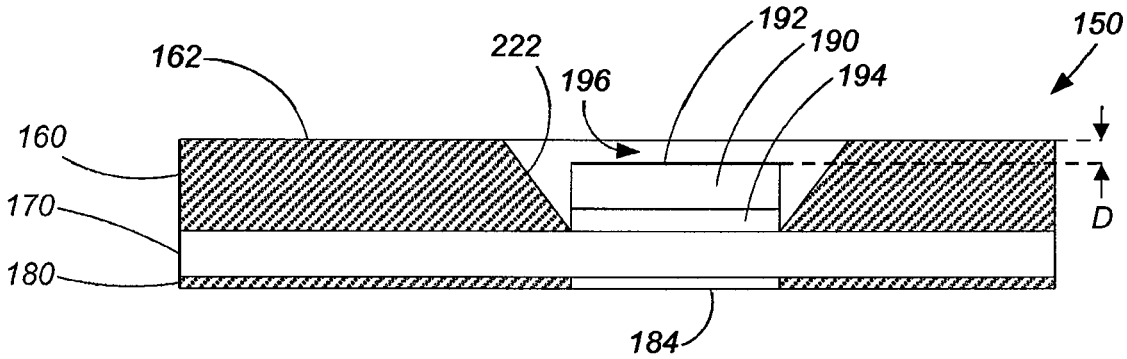

Alternatively, as shown in FIG. 3F, a portion of a non-transparent adhesive layer 180 can be replaced with a transparent PSA. In a another implementation, the entire adhesive layer 180 can be formed from a transparent adhesive, such as a transparent PSA (as shown in FIG. 3A). A transparent adhesive used to replace part or all of adhesive layer 180 can include a double sided tape, such as a clear double-coated tape that diffuses less than 50% of incoming light for a wavelength range of about 400-2000 nm. For example, a transparent adhesive material can include clear double-coated tape that diffuses less than 50% of incoming light for a wavelength range of 380-800 nm.

Naturally, if the adhesive layer 180 is partially non-transparent to the wavelengths of interest to the detector, then either of the techniques shown in FIGS. 3E or 3F to improve the transparency of the adhesive layer can be combined with any of the techniques shown in FIGS. 3B, 3C or 3D to secure the window member 190 to the remainder of the polishing pad. Moreover, in still another implementation, the polishing pad may not include any window member at all.

Figure 4:
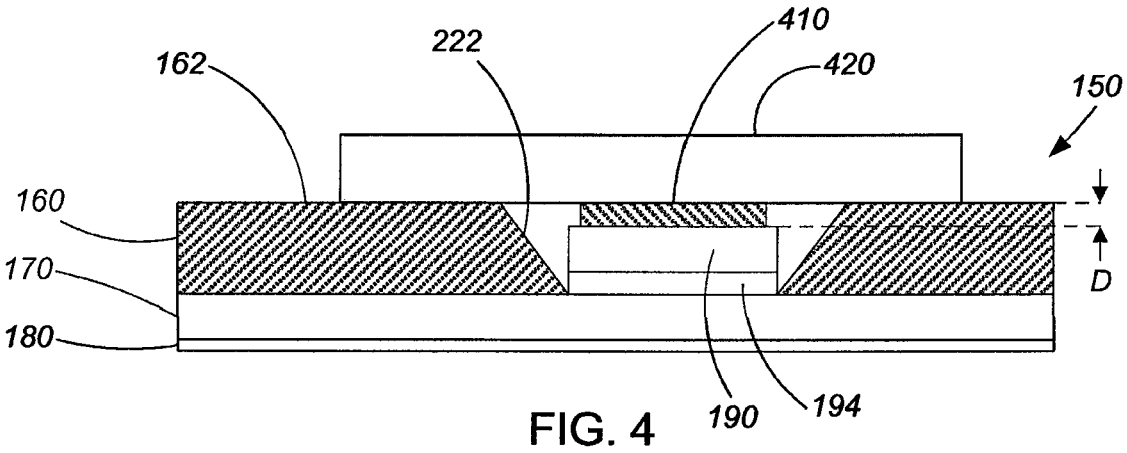
FIG. 4 is a cross-sectional view of the polishing pad of FIG. 2 during bonding of the window to the polishing pad.

FIG. 4 illustrates bonding of window member 190 to supporting layer 170 to form the polishing pad of FIGS. 3A. The opening 222 can be formed by scraping away a portion of the polishing layer 160. To bond window member 190 to supporting layer 170, a continuous bead of window bonding adhesive is placed on supporting layer 170 to form the bonding layer 194. The window member 190 is placed on supporting layer 170 to extend at least partially through the opening 222 in the polishing layer 160. A weight 420 is placed on the polishing surface 162 of the, polishing layer 160, and the window member 190 is pressed with the weight 420 until the bonding adhesive is cured.

A spacer 410 of a predetermined thickness D can be placed between the window member 190 and the weight 420. The predetermined thickness is based on the desired size of the window recess 196. The use of a spacer ensures consistency in achieving the desired size of the window recess 196. The spacer can be formed of a polymer material, such as Polytetrafluoroethylene ("PTFE") or Teflon™, distributed by E.I. du Pont de Nemours and Company of Wilmington, Del. After the window-bonding adhesive is cured, the weight 420 and the spacer are removed.

Figure 5:
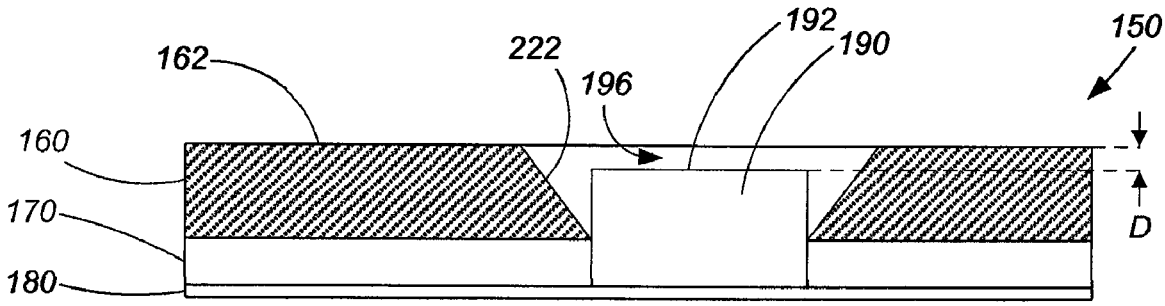
FIG. 5 is a schematic cross-sectional view of an alternate implementation of a polishing pad with a window.

FIG. 5 illustrates yet another alternative implementation of a polishing pad 150 having a window. Polishing pad 150 includes a polishing layer 160, a supporting layer 170 and an adhesive layer 180. Polishing layer 160 includes a polishing surface 162. In this implementation, a window member 190 is placed on adhesive layer 180, instead of on a PSA layer 192 located between the polishing layer 160 and a supporting layer 170. The window member 190 in this implementation is thicker than the window member 190 of FIGS. 3A-3F. A window recess 196 is defined between the plane in which polishing surface 162 lies and the plane in which a top surface 192 of the window member 190 lies. The size of window recess 196 is determined as described above with reference to FIG. 3. Use of a thicker window member 190 on adhesive layer 180 allows the optical monitoring system 120 to monitor the polishing operation through fewer materials.

Nevertheless, it will be understood that various modifications may be made without departing from the spirit and scope of the invention. For example, a portion of opening 222 in polishing layer 160 can be filled with a transparent solid piece, such as a quartz block (e.g., within window member 190).

As another example, polishing head 130 and semiconductor substrate 140 can translate during operation of apparatus 100. In general, light source 122 and light detector 124 are positioned such that they have a view of substrate 140 during a portion of the rotation of platen 110, regardless of the translational position of head 130. As a further example, optical monitoring system 120 can be a stationary system located below platen 110.

As an additional example, the polishing layer can be a durable microporous polyurethane layer, a fibrous layer, a fixed-abrasive layer, or some other sort of layer. As an additional example, the support layer 170 may be located so that it spans the aperture 222 below the window member 190 but does no extend across the entire polishing pad width. As still another example, the support layer 170 may be light-transmitting only in a portion spanning the aperture 222, and the remainder of the support layer 170 may be a different material that is not light-transmitting.

Accordingly, other implementations are within the scope of the following claims.

What is claimed is:

1. A method of constructing a polishing pad having a window, the method comprising:

placing a window member in an opening of a polishing layer of a polishing pad having a polishing layer;

placing the window member against an adhesive sealant;

placing a spacer having a depth of a predetermined distance between the window member and a weight; and pressing the window member against an adhesive sealant with the spacer and the weight while the adhesive sealant is cured so that a transparent layer of the polishing pad positioned below the polishing layer supports the window member and a top surface of the window member is spaced the predetermined distance below the polishing surface of the polishing layer.

2. The method of claim 1 wherein the adhesive sealant comprises a continuous bead of adhesive sealant on one or more of a window member and a window member holding portion of a polishing pad.

3. The method of claim 1, wherein the spacer includes a polytetra-fluoroethylene sheet.

4. The method of claim 2, wherein the adhesive sealant includes a viscous rubber-like glue.

5. The method of claim 2, wherein the adhesive sealant is placed on the window member holding portion.

6. The method of claim 2, wherein the adhesive sealant is placed on the window member.

7. The method of claim 2, wherein the window member holding portion includes a supporting layer of the polishing pad.

8. The method of claim 7, wherein the supporting layer is a polyethylene terephthalate layer.

9. The method of claim 2, wherein the window member holding portion includes a pressure sensitive adhesive layer.

10. The method of claim 2, further comprising:

abrading the top surface and a bottom surface of the window member.

11. The method of claim 2, further comprising:

removing a portion of the polishing layer to form the opening in the polishing layer.

12. A method of constructing a polishing pad having a window, the method comprising:

placing a window member in an opening of a polishing layer of a polishing pad having a polishing layer so that a transparent layer of the polishing pad positioned below the polishing layer supports the window member;

placing a spacer having a depth on the window member;

pressing the window member into the opening with a weight-imparting element while the spacer is between the window member and the weight;

securing the window member in the opening with an adhesive; and removing the spacer so that a top surface of the window member is spaced a distance below the polishing surface of the polishing layer about equal to the depth of the spacer.

* * * * *